US011299865B2

(12) United States Patent
Li et al.

(10) Patent No.: US 11,299,865 B2
(45) **Date of Patent: *Apr. 12, 2022**

(54) PROTECTION METHOD AGAINST RAIN EROSION FOR SOIL SLOPE IMPROVED BY PHOSPHOGYPSUM AND MICROBE

(71) Applicant: INSTITUTE OF GEOLOGY AND GEOPHYSICS, CHINESE ACADEMY OF SCIENCES, Beijing (CN)

(72) Inventors: Zhiqing Li, Beijing (CN); Yingxin Zhou, Beijing (CN); Zhengfu Qian, Beijing (CN); Jianwei Hou, Beijing (CN); Zhonglin Tang, Beijing (CN); Shangfeng Wu, Beijing (CN); Zhiyi Liu, Beijing (CN); Weicheng Zeng, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/193,158

(22) Filed: Mar. 5, 2021

(65) Prior Publication Data

US 2021/0324596 A1 Oct. 21, 2021

(30) Foreign Application Priority Data

Apr. 20, 2020 (CN) ..... 202010313338.8

(51) Int. Cl.
*E02D 17/20* (2006.01)

(52) U.S. Cl.
CPC ..... *E02D 17/202* (2013.01); *E02D 2250/00* (2013.01); *E02D 2300/0025* (2013.01);
(Continued)

(58) Field of Classification Search
CPC ..... E02D 17/20; E02D 17/202
See application file for complete search history.

(56) References Cited

U.S. PATENT DOCUMENTS 4,448,566 A * 5/1984 King ..... E01C 3/003 264/34
10,655,280 B1 * 5/2020 Li ..... E02D 17/20
(Continued)

FOREIGN PATENT DOCUMENTS

AU 2020100902 A4 * 7/2020
CN 106638634 A * 5/2017
(Continued)

*Primary Examiner* — Frederick L Lagman
(74) *Attorney, Agent, or Firm* — Crawford Maunu PLLC

(57) ABSTRACT

The present invention provides a method for protecting a soil slope from rain erosion by improving with phosphogypsum and a microbe. The method includes: (1) placing *Bacillus pasteurii* in a culture medium to prepare a microbial solution, and mixing urea, calcium chloride and water to prepare a cementing solution; (2) mixing a mixture, the microbial solution and water well, and adding the cementing solution and water to prepare an improving mixture slurry; and (3) spraying the improving mixture slurry to a face of the slope twice by wet spraying, mixing the improving mixture slurry with grass seeds well, spraying to the face of the slope once, covering with a non-woven fabric by tying and fixing to the slope, and watering every day.

5 Claims, 2 Drawing Sheets

(52) U.S. Cl.
CPC ..... *E02D 2300/0045* (2013.01); *E02D 2300/0076* (2013.01)

(56) References Cited

U.S. PATENT DOCUMENTS

| | | | | |
|---|---|---|---|---|
| 10,781,562 | B1 * | 9/2020 | Li | C04B 24/126 |
| 10,913,894 | B1 * | 2/2021 | Li | C09K 17/40 |
| 11,124,930 | B1 * | 9/2021 | Li | C04B 28/143 |
| 2009/0050025 | A1 * | 2/2009 | Wissa | E02B 3/10 106/786 |
| 2020/0263364 | A1 * | 8/2020 | Li | C04B 28/26 |

FOREIGN PATENT DOCUMENTS

| | | | | |
|---|---|---|---|---|
| CN | 106812142 | A | * | 6/2017 |
| CN | 108360516 | A | * | 8/2018 |
| CN | 108901648 | A | * | 11/2018 |
| CN | 109566290 | A | * | 4/2019 |

* cited by examiner

PROTECTION METHOD AGAINST RAIN EROSION FOR SOIL SLOPE IMPROVED BY PHOSPHOGYPSUM AND MICROBE

TECHNICAL FIELD

The present invention relates to the field of slope engineering, and in particular to a method for protecting a soil slope from rain erosion by improving with phosphogypsum and a microbe.

BACKGROUND

The soil slopes have weak resistance to erosion. The excavation of slopes on collapsible loess during rains is prone to serious rain erosion, resulting in landslide hazards. The conventional slope protection methods include arched slope protection, grid beam slope protection, mortar rubble slope protection and other protection measures. These methods have high cost, and their gray protection design is inharmonious with the surrounding landscape, and easy to cause secondary collapse.

Phosphogypsum is a byproduct produced in the production of phosphoric acid with apatite and sulfuric acid by wet process in chemical plants. The production of 1 ton of phosphoric acid yields about 5 tons of phosphogypsum. Phosphogypsum is a powdery material with little plasticity. It is slightly acidic due to the residual phosphoric acid, sulfuric acid and hydrofluoric acid. In addition, phosphogypsum is rich in available phosphorus, which can be used for plant growth. China annually produces more than 8 million tons of phosphogypsum, and has overstocked more than 300 million tons of phosphogypsum. If the phosphogypsum is applied to engineering design through technical measures, the overstocked phosphogypsum will be greatly reduced. This will save the land resources, avoid the collapse of phosphogypsum dams, and turn waste into treasure to give play to the benefits of phosphogypsum.

The soil contains a large number of microbes, and functional microbes can be selected and cultured for slope protection, which can cement soil particles, resist rain erosion, and promote plant growth. The addition of microbes is conducive to harmonize the slope protection with the surrounding ecological environment.

SUMMARY

An objective of the present invention is to provide a method for protecting a soil slope from rain erosion by improving with phosphogypsum and a microbe. The present invention protects the soil slope from rain erosion and landslides, and reduces the stock of solid phosphogypsum waste, thereby saving the land resources and harmonizing with the surrounding ecological environment.

The present invention adopts the following technical solution: a method for protecting a soil slope from rain erosion by improving with phosphogypsum and a microbe, including the following steps:

(1) placing *Bacillus pasteurii* in a culture medium to prepare a microbial solution, and mixing urea, calcium chloride and water to prepare a cementing solution;

(2) mixing a mixture, the microbial solution and water well, and adding the cementing solution and water to prepare an improving mixture slurry;

(3) leveling an excavated slope; constructing an intercepting ditch on 1 a crest of the slope, a drainage ditch 2 on a toe of the slope and a drainage groove 3 on a face of the slope; laying and fixing a three-dimensional vegetation net 4 on the face of the slope; and (4) spraying the improving mixture slurry by wet spraying to the face of the slope twice from top to bottom and left to right with a thickness of 4±1 cm each; then mixing the improving mixture slurry with grass seeds well, and spraying to the face of the slope once with a thickness of 4±1 cm; then covering with a non-woven fabric by tying and fixing, and watering every day.

In step (1), a mixed solute in the culture medium includes bean pulp, $(NH_4)_2SO_4$, $Na_2HPO_4$ and NaOH; 40 parts of bean pulp, 10 parts of $(NH_4)_2SO_4$, 3.55 parts of $Na_2HPO_4$ and 40 parts of NaOH are weighed by mass to prepare the mixed solute of the culture medium; the mixed solute of the culture medium is mixed with water to prepare a liquid medium; the content of the bean pulp in the liquid medium is controlled at 20-60 g/L; the liquid medium is sealed and sterilized in an autoclave at 121° C. for 25 min, and then cooled to 30±2° C. for use; 1 part by volume of *Bacillus pasteurii* solution is added to 100 parts by volume of liquid medium to prepare the microbial solution; the microbial solution is placed into a constant-temperature shaking incubator at 30° C., and shook at 200 rpm for more than 24 h until an optical density of the *Bacillus pasteurii* in the microbial solution at a wavelength of 600 nm ($OD_{600}$) is 1.5±0.2.

In step (1), the mixed solute in the cementing solution includes urea and calcium chloride; 2 parts of granular urea and 1 part of powdered calcium chloride are weighed by mass to prepare the mixed solute, and the mixed solute is mixed with water to prepare the cementing solution with a concentration of 0.5±0.1 mol.

In step (2), the mixture includes phosphogypsum, alkaline slag and soil; 19 parts of phosphogypsum, 1 part of alkaline slag and 40-50 parts of soil are weighed by dry mass, and are mixed well to obtain the mixture, where the soil in the mixture is loess, silt, loam or planting soil.

In step (2), 100-1,000 parts of mixture, 1 part of microbial solution and 10 parts of cementing solution are weighed by volume; the 100-1,000 parts of mixture and 1 part of microbial solution are first mixed with water well, where the water is added until a moisture content of the soil in the mixture reaches a liquid limit; then the 10 parts of cementing solution and water are added and mixed well to obtain the improving mixture slurry, where the water is added until the improving mixture slurry is thin enough to be sprayed from a spray pipe by greening wet spraying.

In step (2), the microbial solution and the cementing solution are each added once in the whole process.

In step (3), the three-dimensional vegetation net is laid on the face of the slope from top to bottom, and extends 40-80 cm on the crest of the slope to be buried in the soil and compacted; a longitudinal/transverse tensile strength of the three-dimensional vegetation net is greater than 1.0 kN/m.

In step (4), the prepared improving mixture slurry is sprayed to the face of the slope in 6 h; the total thickness of the sprayed improving mixture slurry on the face of the slope is not less than 10 cm; not less than 25 g of grass seeds are sown per square meter of the face of the slope.

Advantages of the Present Invention

The protection method is simple in construction. It meets the requirements of rain erosion resistance and greening protection for soil slopes, such as loess, silt, red clay and gravelly soil slopes. It reduces the stock of solid phosphogypsum waste, thereby reducing the occupation of cultivated land, and promotes plant growth with available phosphorus in the phosphogypsum, turning waste into treasure. The microbial culture uses a cheap medium, which reduces the operation cost. The microbial improvement of the phosphogypsum achieves the immobilization of harmful elements, thereby reducing environmental pollution.

Applications of the Present Invention

Greening protection and rain erosion resistance protection of slopes in highway and railway engineering, etc.

DETAILED DESCRIPTION

Figure 1:
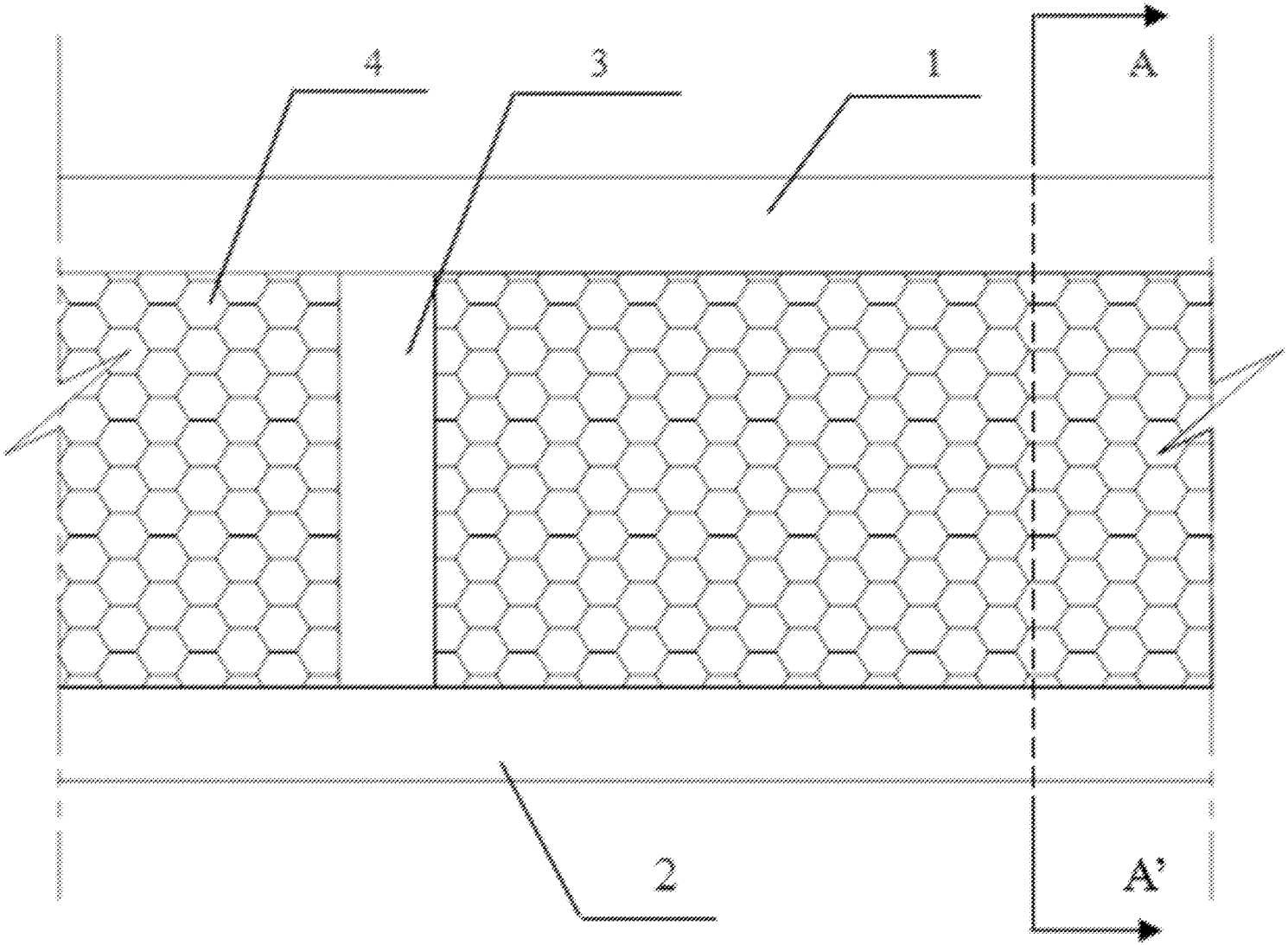
FIG. 1 is a schematic elevation view of a slope paved with a three-dimensional vegetation net, where 1 refers to an intercepting ditch, 2 refers to a drainage ditch, 3 refers to a drainage groove and 4 refers to a three-dimensional vegetation network.

Example: a method for protecting a soil slope from rain erosion by improving with phosphogypsum and a microbe, including the following steps:

(1) Prepare a culture medium and a microbial solution: weigh 40 kg of bean pulp, 10 kg of $(NH_4)_2SO_4$, 3.55 kg of $Na_2HPO_4$ and 40 kg of NaOH to prepare a mixed solute of the culture medium; mix the mixed solute of the culture medium with 1,000 kg of water to prepare a liquid medium; seal and sterilize the liquid medium in an autoclave at 121° C. for 25 min, and then cool to 30° C. for use; add 10 L of *Bacillus pasteurii* solution to the liquid medium to prepare the microbial solution; place the microbial solution into a constant-temperature shaking incubator at 30° C., and shake at 200 rpm for more than 24 h until an optical density of the *Bacillus pasteurii* in the microbial solution at a wavelength of 600 nm ($OD_{600}$) is 1.5.

(2) Prepare a cementing solution: weigh 1,200 kg of urea and 600 kg of calcium chloride, mix with water to prepare 10,100 L of cementing solution with a concentration of 0.5 mol.

(3) Prepare a mixture: weigh 214.8 t of phosphogypsum, 11.3 t of alkaline slag and 531.4 t of loam, and mix well to obtain the mixture.

(4) Prepare an improving mixture slurry: mix 505 $m^3$ of mixture, 1 $m^3$ of microbial solution and 100 $m^3$ of water well; then add 10 $m^3$ of cementing solution and 40 $m^3$ of water, and mix well to obtain the improving mixture slurry, where the mixture has a bulk density of 1.5 $g/cm^3$.

Figure 2:
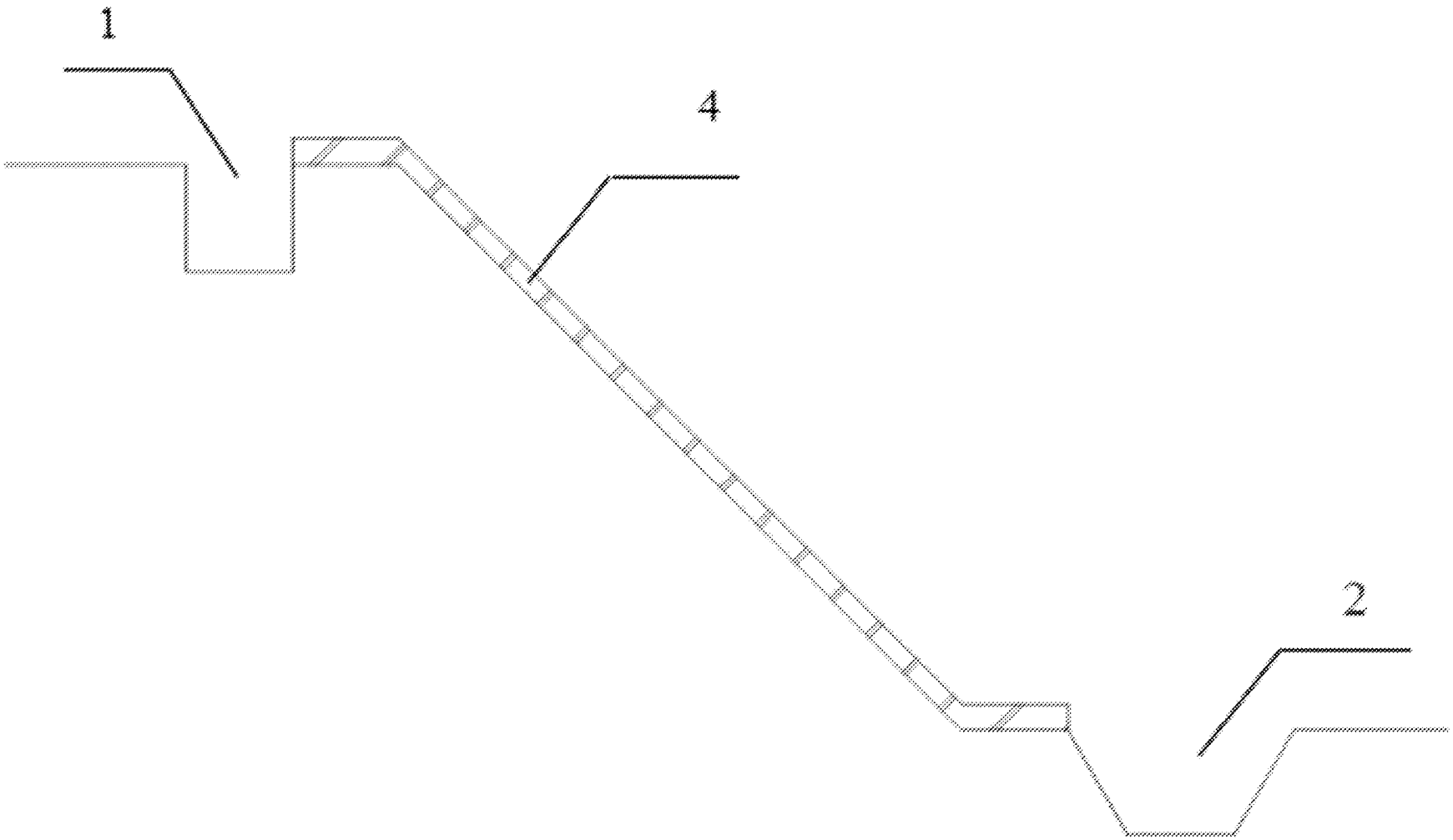
FIG. 2 is a schematic cross-sectional view of AN in FIG. 1, where 1 refers to an intercepting ditch, 2 refers to a drainage ditch, and 4 refers to a three-dimensional vegetation network.

(5) Slope protection: with reference to FIGS. 1-2, level an excavated slope; construct an intercepting ditch 1 on a crest of the slope, a drainage ditch 2 on a toe of the slope and a drainage groove 3 on a face of the slope; lay a three-dimensional vegetation net 4; spray the improving mixture slurry by wet spraying to the face of the slope twice from top to bottom and left to right with a thickness of 3 cm each; then mix the improving mixture slurry with grass seeds well, and spray to the face of the slope once with a thickness of 4 cm; then cover with a non-woven fabric by tying and fixing to the slope, and water every day.

What is claimed is:

1. A method for protecting a soil slope from rain erosion by improving with phosphogypsum and a microbe, comprising the following steps:

(1) placing *Bacillus pasteurii* in a culture medium to prepare a microbial solution, and mixing urea, calcium chloride and water to prepare a cementing solution;

(2) mixing a mixture, the microbial solution and water well, and adding the cementing solution and water to prepare an improving mixture slurry;

(3) leveling an excavated slope; constructing an intercepting ditch on a crest of the slope, a drainage ditch on a toe of the slope and a drainage groove on a face of the slope; laying and fixing a three-dimensional vegetation net on the face of the slope; and (4) spraying the improving mixture slurry by wet spraying to the face of the slope twice from top to bottom and left to right with a thickness of 4±1 cm each; then mixing the improving mixture slurry with grass seeds well, and spraying to the face of the slope once with a thickness of 4±1 cm; then covering with a non-woven fabric by tying and fixing, and watering every day.

2. The method for protecting a soil slope from rain erosion by improving with phosphogypsum and a microbe according to claim 1, wherein in step (1), a mixed solute in the culture medium comprises bean pulp, $(NH_4)_2SO_4$, $Na_2HPO_4$ and NaOH; 40 parts of bean pulp, 10 parts of $(NH_4)_2SO_4$, 3.55 parts of $Na_2HPO_4$ and 40 parts of NaOH are weighed by mass to prepare the mixed solute of the culture medium; the mixed solute of the culture medium is mixed with water to prepare a liquid medium; the content of the bean pulp in the liquid medium is controlled at 20-60 g/L; the liquid medium is sealed and sterilized in an autoclave at 121° C. for 25 min, and then cooled to 30±2° C. for use; 1 part by volume of *Bacillus pasteurii* solution is added to 100 parts by volume of liquid medium to prepare the microbial solution; the microbial solution is placed into a constant-temperature shaking incubator at 30° C., and shook at 200 rpm for more than 24 h until an optical density of the *Bacillus pasteurii* in the microbial solution at a wavelength of 600 nm ($OD_{600}$) is 1.5±0.2; and wherein in step (1), the mixed solute in the cementing solution comprises urea and calcium chloride; 2 parts of granular urea and 1 part of powdered calcium chloride are weighed by mass to prepare the mixed solute, and the mixed solute is mixed with water to prepare the cementing solution with a concentration of 0.5±0.1 mol.

3. The method for protecting a soil slope from rain erosion by improving with phosphogypsum and a microbe according to claim 1, wherein in step (2), the mixture comprises phosphogypsum, alkaline slag and soil; 19 parts of phosphogypsum, 1 part of alkaline slag and 40-50 parts of soil are weighed by dry mass, and are mixed well to obtain the mixture, wherein the soil in the mixture is loess, silt, loam or planting soil; wherein in step (2), 100-1,000 parts of mixture, 1 part of microbial solution and 10 parts of cementing solution are weighed by volume; the 100-1,000 parts of mixture and 1 part of microbial solution are first mixed with water well; then the 10 parts of cementing solution and water are added and mixed well to obtain the improving mixture slurry, wherein the microbial solution and the cementing solution are each added once in the whole process.

4. The method for protecting a soil slope from rain erosion by improving with phosphogypsum and a microbe according to claim 1, wherein in step (3), the three-dimensional vegetation net is laid on the face of the slope from top to bottom, and extends 40-80 cm on the crest of the slope to be buried in the soil and compacted; a longitudinal/transverse tensile strength of the three-dimensional vegetation net is greater than 1.0 kN/m.

5. The method for protecting a soil slope from rain erosion by improving with phosphogypsum and a microbe according to claim 1, wherein in step (4), the prepared improving mixture slurry is sprayed to the face of the slope in 6 h; the total thickness of the sprayed improving mixture slurry on the face of the slope is not less than 10 cm; not less than 25 g of grass seeds are sown per square meter of the face of the slope.

* * * * *